United States Patent [19]

Herbert

[11] Patent Number: 4,665,357

[45] Date of Patent: May 12, 1987

[54] FLAT MATRIX TRANSFORMER

[76] Inventor: Edward Herbert, Rte. 44, Canton, Conn. 06019

[21] Appl. No.: 825,230

[22] Filed: Feb. 4, 1986

Related U.S. Application Data

[63] Continuation-in-part of Ser. No. 602,959, Apr. 23, 1984, abandoned.

[51] Int. Cl.[4] ..... H01F 19/00

[52] U.S. Cl. ..... 323/361; 323/345; 336/175

[58] Field of Search ..... 323/328, 338, 339, 345, 323/361; 336/175; 307/17, 83

[56] References Cited

U.S. PATENT DOCUMENTS

| | | | |
|---|---|---|---|
| 378,321 | 2/1888 | Kennedy | 336/182 |
| 2,600,057 | 6/1952 | Kerns | 336/175 |
| 2,945,961 | 7/1960 | Healis | 336/175 |
| 3,105,959 | 10/1963 | Klinkhamer | 365/189 |
| 3,110,888 | 11/1963 | Kluck | 365/189 |
| 3,156,886 | 11/1964 | Sutherland | 336/212 |
| 3,323,091 | 5/1967 | Hibbits | 336/175 |
| 3,477,016 | 11/1969 | Papaleonidas | 323/346 |
| 4,513,167 | 4/1985 | Brandstetter | 323/906 |

*Primary Examiner*—Patrick R. Salce
*Assistant Examiner*—Jeffrey Sterrett

[57] ABSTRACT

A flat matrix transformer or inductor is made of a plurality of interdependant magnetic circuits, arranged in a matrix, between and among which electrical conductors are interwired, the whole cooperating to behave as a transformer or inductor. The flat matrix transformer or inductor has several advantageous features, among them compact size, good heat dissipation and high current capability. A flat matrix transformer or inductor can be very flat indeed, nearly planar, and can be built using printed circuit board techniques. A flat matrix transformer can insure current sharing between parallel power sources, and/or between parallel loads. The flat matrix transformer can be configured to have a variable equivalent turns ratio.

20 Claims, 25 Drawing Figures

FLAT MATRIX TRANSFORMER

This is a continuation-in-part of application Ser. No. 602,959, filed Apr. 23, 1984, now abandoned.

BACKGROUND OF THE INVENTION

1. Field of the Invention

This is a continuation-in-part of application Ser. No. 602,959, filed Apr. 23, 1984, now abandoned.

This invention relates to magnetic circuits, and in particular to transformers, inductors and related components.

2. Description of Prior Art:

The conventional art of transformer or inductor design is well known. A transformer or inductor usually consists of a magnetic core structure with windings thereon.

Several earlier patents have taught that transformers can be arranged in various ways to meet specialized design objectives.

U. S. Pat. No. 3,477,016, Papaleonidas, Nov. 4, 1969 shows a "compound" transformer which is an aggregation of magnetically independent conventional transformers wired in series/parallel and intentended to be operated with source having much higher impedance than that of the transformers.

U. S. Pat. No. 2,600,057, Kerns, June 10, 1952 shows an aggregation of conventional transformers, with parallel primaries and series secondaries, the use being very high voltage applications.

U. S. Pat. No. 378,321, Kennedy, Feb. 21, 1888 and U.S. Pat. No. 3,156,886, Southeland, Nov. 10 1964, show transformers having a plurality of sections on a common magnetic structure, each section of which is a conventional transformer, the sections being wired together in series and/or parallel.

U. S. Pat. No. 2,945,961, Healis, July 19, 1960 shows an inductor with multiple elements, each coupled to the next to insure current balancing in parallel loads.

SUMMARY OF THE INVENTION

This invention teaches that a plurality of small interdependant magnetic elements can be interwired in a matrix to behave as a transformer or inductor.

Transformers and inductors are both special cases of a broad family of static devices in which electric currents in conductors interact by means of magnetic induction with changing fluxes in magnetic cores. These include potential transformers (ordinary transformers), current transformers, flyback transformers, induction coils, "constant current output" transformers, multiple winding inductors and inductors. "Matrix transformer" is used herein as a generic term including any of these devices when they are built using an array of smaller interdependent magnetic element interwired as a whole.

The matrix transformer designed in this way functions as an ordinary transformer, but because of the manner in which the various elemental parts cooperate interdependantly, it has some unique characteristics which can be used to advantage in many applications. Matrix transformers can also be designed which have characteristics which no single core device could have.

The magnetic elements can be small cores of ordinary design, such as C cores, E-I cores, pot cores or toroids, but alternatively can be one of several new geometries having multiple magnetic return paths such as two parallel plates bridged by a multitude of posts, a plurality of modified cross cores, or a plate of magnetic material having a plurality of holes therein. Different types of interdependant magnetic elements can be inter-mixed in an interdependant matrix array as long as the rules of transformers are followed.

The matrix transformer can be very flat, and the electrical circuits can be made using printed wiring board techniques. A three dimensional matrix transformer, while not flat, is a logical derivative of the flat transformer, and has a third electrical circuit orthogonal to the other two. A cyclically wound matrix transformer is an embodiment using a smaller number of cores. Equivalent matrix transformers and inductors can be made with a variety of physical arrangements of the elements.

In one embodiment, the matrix transformer is designed to have a variable equivalent turns ratio, which can be varied by electronic switching. This allows controlling the output voltage of a circuit by varying the equivalent turns ratio by electronic switching means, which could be useful as a voltage regulating circuit, a voltage controlling circuit or an amplifying circuit.

DESCRIPTION OF THE FIGURES

FIGS. 7 through 10 show an alternative geometry matrix transformer especially suitable for printed circuit boards.

FIG. 8 is a sectional view of the magnetic structure of FIG. 7 installed on a printed circuit board.

FIG. 9 is a diagramatic representation of a corner of the transformer of FIG. 8.

FIG. 10 is the section A—A of FIG. 9.

DESCRIPTION OF THE PREFERRED EMBODIMENTS

The art of designing and manufacturing matrix transformers and inductors is adaptable to a very wide variety shapes, sizes and configuration. The principles, once learned, will enable the skilled practitioner to tailor individual designs to a number of diverse requirements.

Figure 1:
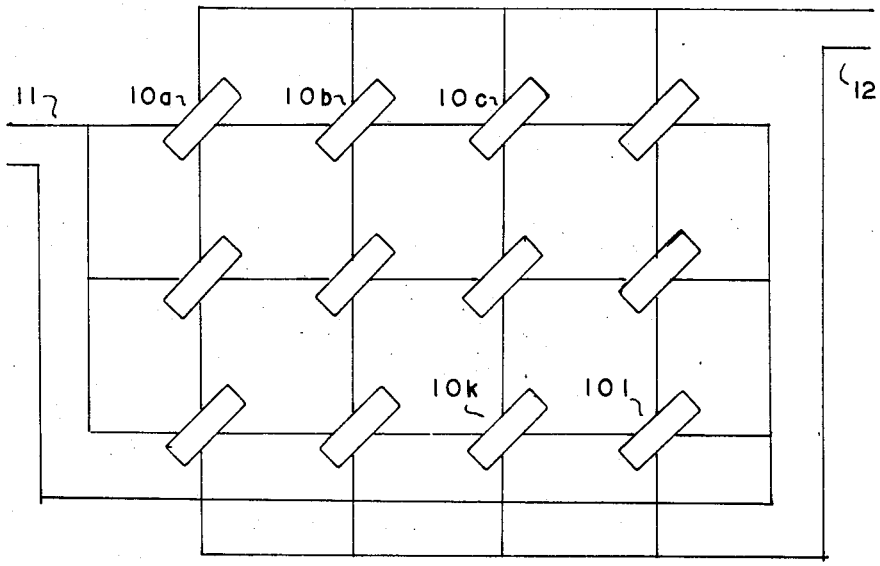
FIG. 1 is a diagramatic representation of a two dimension matrix transformer.

FIG. 1 shows a very basic matrix transformer having twelve magnetic elements, in this case toroids 10*a–l*. The magnetic elements are arranged in three rows and four columns. The primary circuit 11 consists of three parallel paths, each making a single pass through the length of a row, and connected together at the ends. The secondary circuit 12 consists of four parallel paths, each making a single pass through the length of each column, and connected together at the ends. The secondary circuit 12 is at right angles to the primary circuit 11 as shown in FIG. 1, and care is taken to ensure that circuit passes through the toroids from the same side. A matrix transformer in which the primary and the secondary circuits cross each other at right angles at each magnetic element, as in the matrix transformer of FIG. 1, is said to be "orthogonal".

All the laws of transformers apply to each magnetic element 10*a–l* with its associated portion of the primary circuit 11 and the secondary circuit 12. The volts per turn of all windings is the same. In the case of the transformer elements of the matrix transformer of FIG. 1, each element has a primary wire and a secondary wire which makes a single pass through the element. Therefor the number of "turns" of each "winding" is one. Since this is often the case of matrix transformers, "turns", "turns ratio" and "windings" are misnomers, but their use is continued, as it is the accepted jargon of the art of transformers.

Also, the sum of the ampere-turns of each transformer element must equal zero (ignoring magnitization current). This requirement leads to a very interesting and valuable characteristic of orthogonal matrix transformers, which is that the currents in the parallel paths of the primary circuit 11 and the currents in the parallel paths of the secondary circuit 12 must all be equal. (If either or both of the circuits has multiple turns on each element, the law still applies, but the number of turns must be factored in).

The equivalent turns ratio of the matrix transformer of FIG. 1 is four to three. This can be shown by examining either the voltage or the current relationship, applying the Transformer laws to each of the interdependant magnetic elements, then taking the sums. The primary circuit 11 drops through four elements in each of the parallel paths, and the secondary circuit 12 is sourced through three elements in each of the parallel paths. Since the voltage of each "turn" of each element must be equal, the secondary voltage will be $\frac{3}{4}$ of the primary voltage. Likewise, the primary circuit 11 is divided into three parallel paths, and the secondary 12 is devided into four parallel paths. Since the current in each path is equal, the total secondary current is 4/3 of the total primary current.

Figure 2:
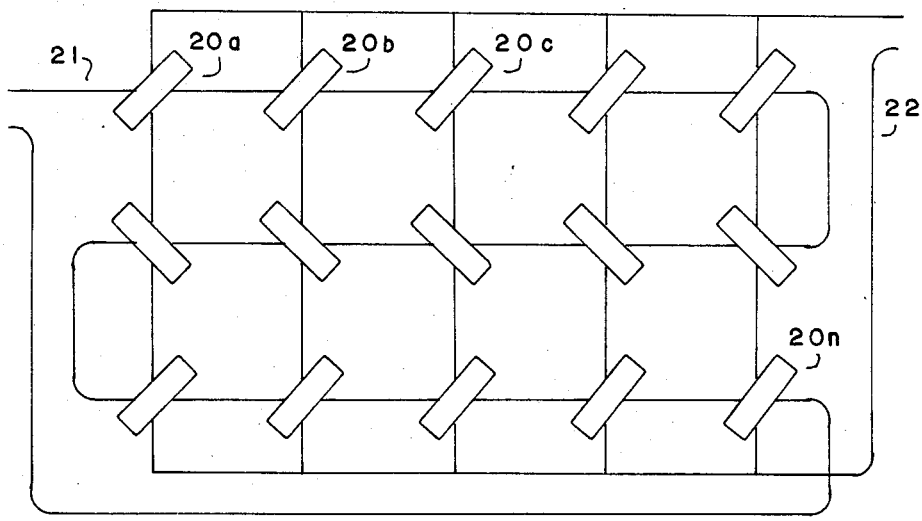
FIG. 2 is a diagramatic representation of a variation of a two dimension matrix transformer.

FIG. 2 shows another matrix transformer, in which the primary circuit 21 passes through all of the interdependant magnetic elements 20*a–n* and the secondary circuit 22 is arranged as five parallel paths each passing through three of the interdependant magnetic elements. This provides a transformer with an equivalent turns ratio of 15 to 3, or 5 to 1.

In the matrix transformer of FIG. 2, the primary circuit could have made multiple passes through each transformer element, in which case a higher equivalent turns ratio would have been obtained. With four passes, for instance, the equivalent turns ratio would have been 60 to 3, or 30 to 1.

The matrix transformers of FIG. 1 and FIG. 2 serve to show some of the distinctions and advantages of a matrix transformer over a conventional transformer. Some are enumerated here, others will be developed late.

The matrix transformer tends to be flat, almost planar, and can be much lower that a conventional transformer of equivalent volt-amp capacity. This is particularly true for high current applications, where wire size and aperture area can be dominant criteria determining the core size.

Being flat, and essentially open in construction, cooling is readily accomplished. There will be no extreme hot spots.

Often, in conventional transformer design, more turns than would otherwise be necessary or desirable must b e used to achieve a desired turns ratio. More turns leads to more resistance or a larger wire size which leads to a bigger aperture which results in an oversized core. Usually matrix dimensions can be found to provide the ratio desired, and all elements can be optimized.

In a matrix transformer, the higher current circuits tend to be parallel circuits which can be very short. Resistance can therefor be kept to a minimum.

Figure 3:
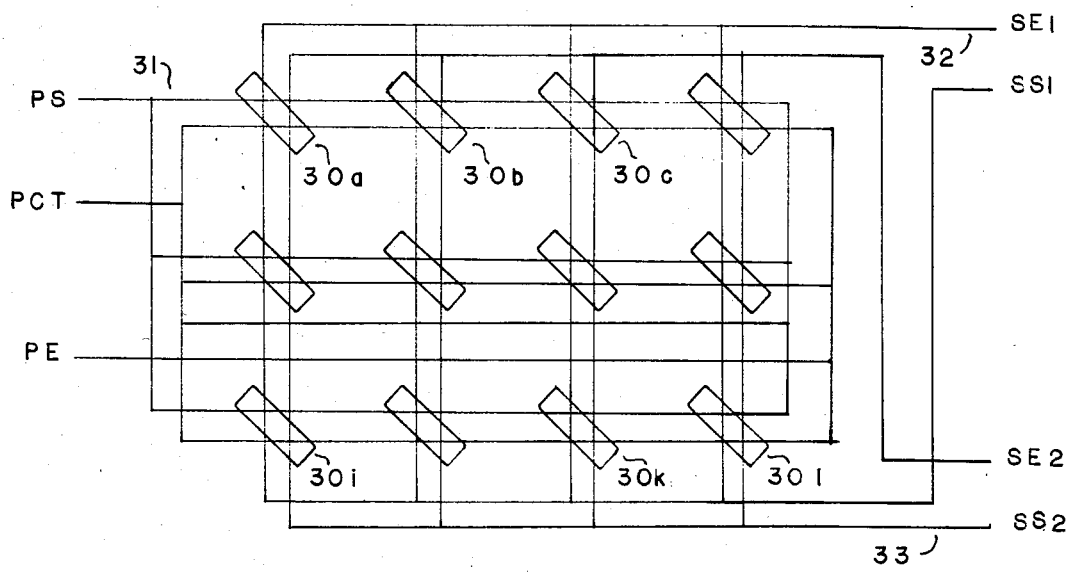
FIG. 3 is a diagramatic representation of a matrix transformer having a "center-tapped" primary and a "split" secondary.

FIG. 3 is a diagramatic representation of a matrix transformer having a core structure 30*a–l* which is similar to that of FIG. 1, but having more complex circuits. The magnetic elements cooperate interdependantly to form an equivalent transformer in which the primary 31 is "center tapped", and the secondary 32, 33 is split.

Figure 4:
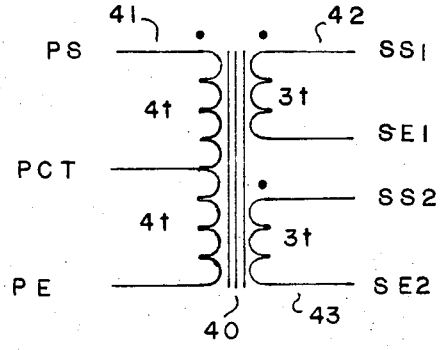
FIG. 4 shows a transformer in conventional schematic representation which is equivalent to the matrix transformer of FIG. 3.

FIG. 4 shows the matrix transformer of FIG. 3 using conventional schematic representation.

Figure 5:
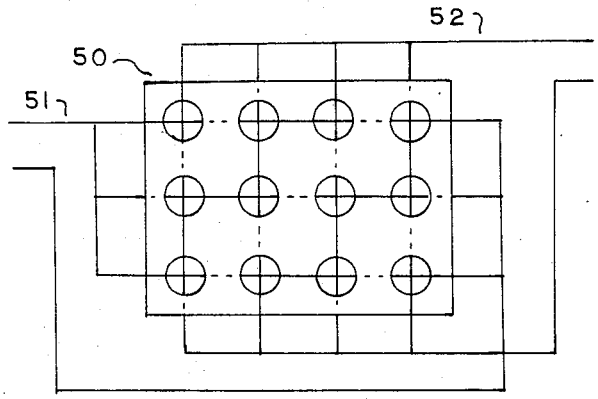
FIG. 5 is a diagramatic representation of a matrix transformer in which the core is a plate of magnetic material having a plurality of holes.

FIG. 5 is a diagramatic representation of a matrix transformer which is functionally equivalent to the matrix transformer of FIG. 1. The core is a plate of magnetic material 50 having a plurality of holes. Each hole with the material around its can be considered to be equivalent to a toroid. The windings 51 and 52 are threaded through the holes, and teh magnetic and electrical circuits as a whole cooperate interdependantly in the same manner as the matrix transformer of FIG. 1 to operate as a transformer.

Figure 6:
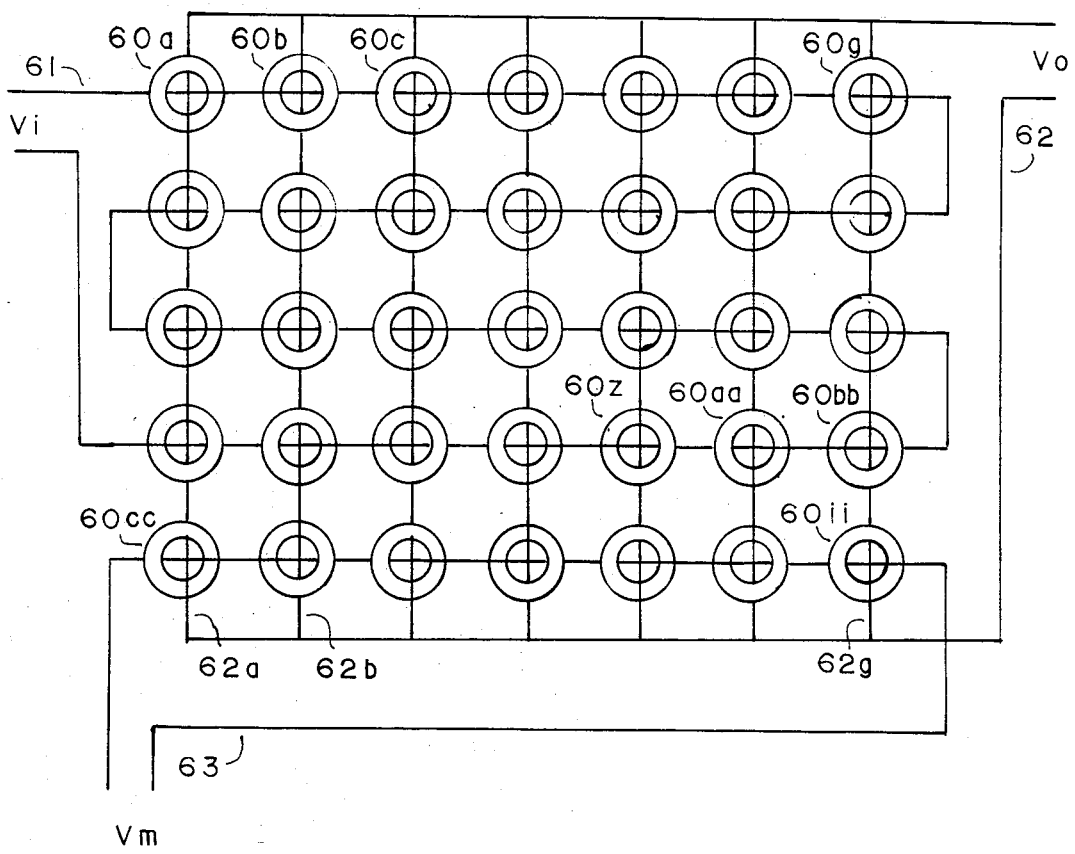
FIG. 6 is a diagramatic representation of a matrix transformer which has additional magnetic elements in each column through which is wired a special winding used to modify the voltage in the columns.

FIG. 6 is a diagramatic representation of a matrix transformer in which an additional winding has been added through additional magnetic elements. This winding is used to modify the voltage in the columns. Thirty five identical magnetic cores 60*a, b,-z, aa,-ii* are used, but the primary winding 61 passes through only twenty eight of them 60*a* through 60*bb*. Additional cores 60*cc* through 60*ii* have been added, one to each column. The secondary 62 passes through all cores 60*a* thruogh 60*ii*, and has seven parallel paths 62*a* through 62*g*. An additional winding 63 passes through the seven cores 60*cc* thrugh 60*ii*.

This extra winding 63 is used to modify the output voltage of the matrix transformer, and several techniques are available.

In studying this example, let us first establish that the current in each wire must be equal. This must be so if the net ampere-turns in each magnetic element is zero. Thus the current in 63 equals the current in 61, and the current in 62 is seven times larger, there being seven parallel paths which add. Given a suitable circuit at Vm, the winding 63 will be a current source.

In one hypothetical circuit, consider that the output of winding 63 is rectified, and taken to a voltage source which is small enough so that the rectifiers will remain forward biased. Ignoring rectifier drop, this voltage will appear as a modifying voltage, and one seventh of it will be subtracted from the output voltage Vo of the matrix transformer. If the modifying voltalge is variable, this suggests a method of controlling the matrix transformer output voltage Vo.

To further develop a hypothetical circuit, consider the effect of short circuiting the winding 63. Except for a parasitic circulating current, there is no effect upon the operation of the matrix transformer, as the modifying voltage is zero.

Given a circuit which can provide a modifying voltage, and also by switching circuits, provide a short circuit, this suggests a method of controlling the output voltage of the matrix transformer Vo by pulse width modulation techniques. The time averaged modifying voltage would be a function of the duty cycle of the switching means between the fixed voltage and the short circuit.

FIGS. 7 through 10 show another alternative physical arrangement of the matrix transformer. This transformer is designed with printed circuit board technology in mind, though it could be wired with wires or a plurality of coils, or one or more winding could be a printed circuit with additional windings of wires or a plurality of coils.

Figure 7A:
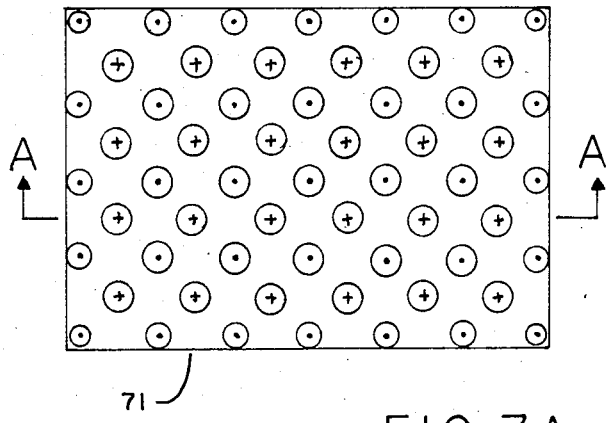
FIGS. 7A and 7B show a plane and an elevation view of a magnetic structure which is designed to pass through holes in a printed circuit board.
Figure 7B:
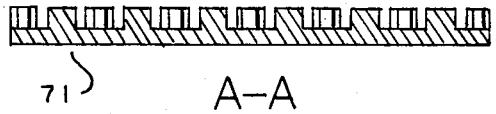

FIGS. 7A and 7B show a plane and an elevation view of a special magnetic structure 71, which is essentially a plate of magnetic material such as ferrite having on it a plurality of posts, arranged in a pattern, and designed to pass through holes in a printed circuit board.

Figure 8:
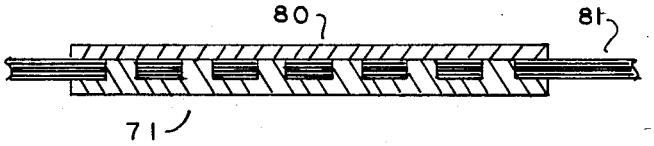

FIG. 8 is a sectional view of the magnetic structure 71 of FIG. 7 installed on a printed circuit board 81. Magnetic return paths are provided by a plate of magnetic material 80.

Figure 9:
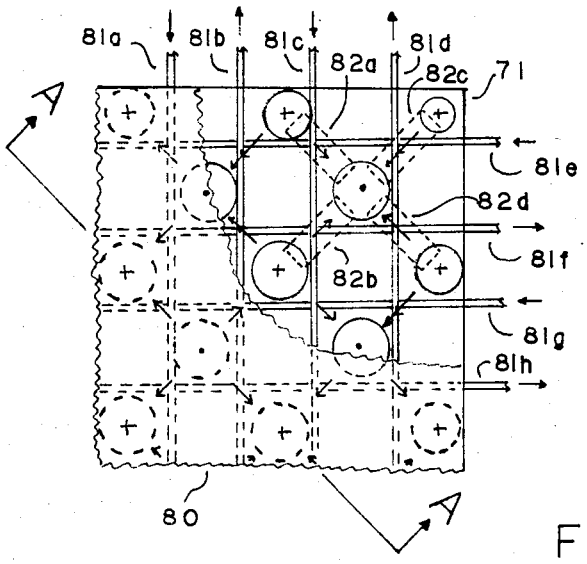

FIG. 9 is a diagramatic representation of a corner of the transformer of FIG. 8, in diagramatic plane view. A corner of the top plate 80 is cut away to show the bottom plate 71, and the printed circuit board circuits are shown diagramatically as wires 81*a–h*. Currents in the printed wires 81*a–h* are shown by arrows, as are the magnetic flux paths within the plates 71 and 80. "Equivalent toroids" 82*a–d* can be used as an analysis aid. Magnetic flux direction in the posts of bottom plate 71 are shown using the dot and cross convention. Similar currents and fluxes exist throughout the matrix transformer, and they cooperate interdependantly in the operation of the matrix transformer.

Figure 10:
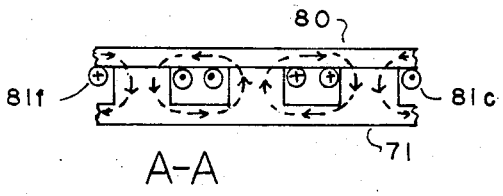

FIG. 10 is a section A—A of FIG. 9. Flux paths are shown by arrows, and currents are shown using the dot and cross convention.

Figure 11A:
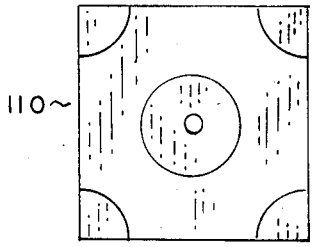
FIGS. 11A and 11B show a plane and an elevation view of one half of a modified cross core.
Figure 11B:
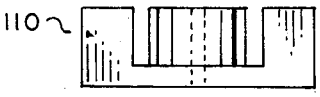
Figure 12:
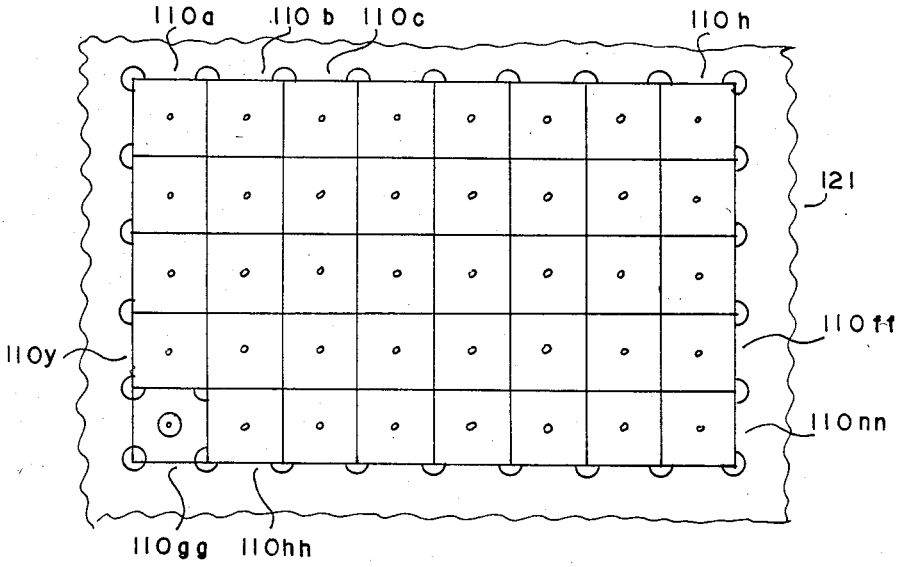
FIG. 12 shows a variation of the matrix transformer using a plurality of modified cross cores which are mounted on and through a printed circuit board.

FIG. 11 and 12 show another alternative matrix transformer, also intended for printed circuit boards. FIGS. 11A and 11B show a plain and an elevation view of a modified cross core 110. As in a conventional cross core, the center is round. The modification consists of making each corner return path into a quarter round. This allows such modified cross cores to be mounted on a printed circuit board, and the return paths where the corners meet can be installed through drilled holes.

Another modification of the cross core would be to have each of the four corner return paths be cylindrical, having one half the diameter (one fourth the area) of the center post. These too could be installed through drilled holes in a printed circuit board, and would be better for applications where the cores did not mount right next to each other.

Electrically and magnetically the matrix transformer of FIG. 12 is identical to the matrix transformer of FIGS. 7 through 10, but it is comprised of many small modified cross cores 110*a–nn* mounted on and thorugh a printed circuit board 121. Advantages of this configuration are that many different matrix transformers can be designed using one part, and the stress due to board flexing is much less. Obviously, the windings in such a matrix transformer could be printed circuits, or wires, or coils or any combination, as long as the transformer laws are not violated when wired into the matrix transformer as a whole.

It is obvious that the magnetic core design of either the matrix transformer of FIGS. 7 through 10 or the matrix transformer of FIGS. 11 and 12 could be used to make a flyback transformer or an inductor by providing a suitable airgap.

C cores, E cores, E-1 cores and so forth could also be mounted on a printed circuit board, providing flux paths for printed conductors or wires, interconnected as a matrix transformer.

Figure 13:
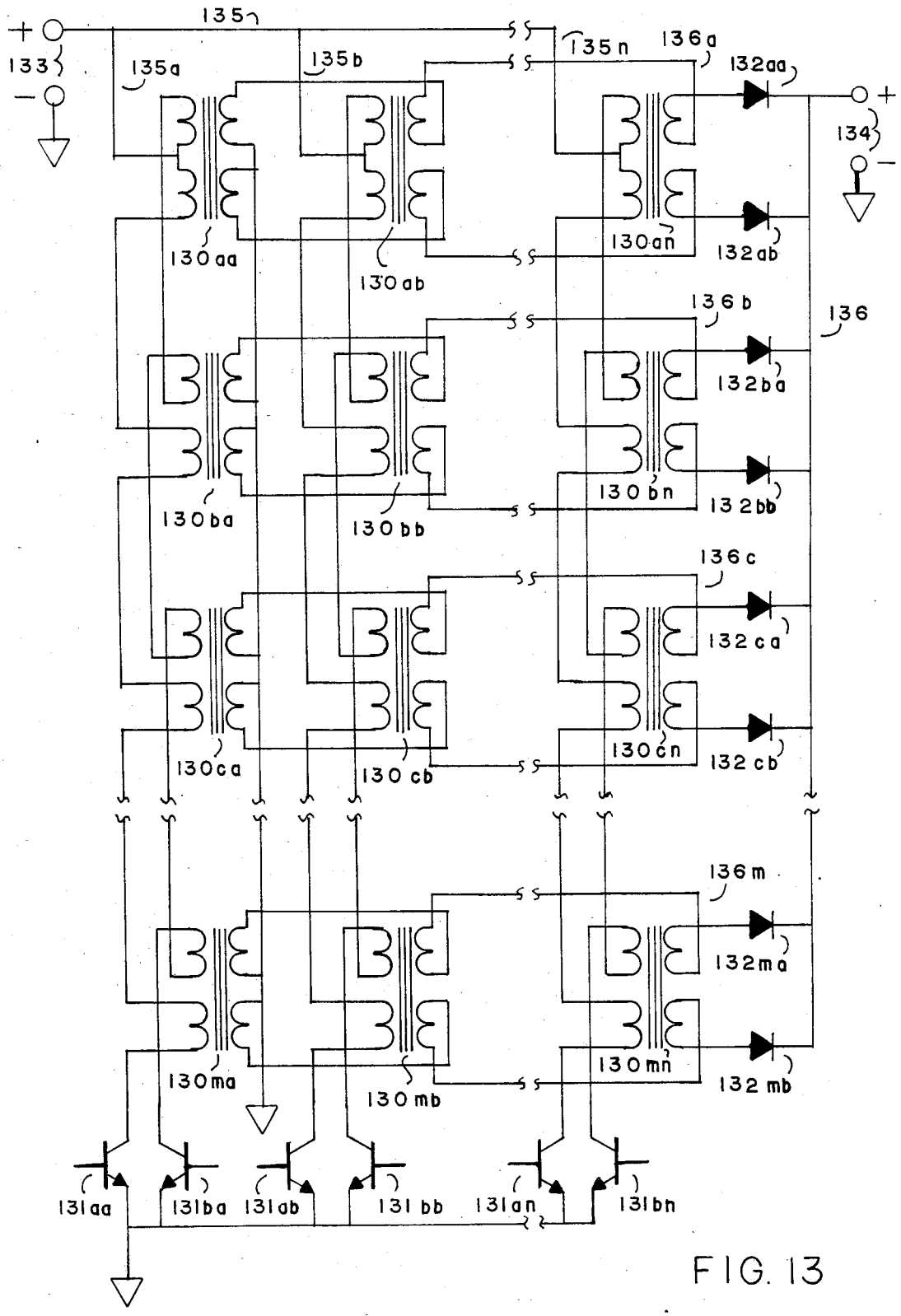
FIG. 13 is a schematic diagram of a matrix transformer of dimension M by N employed in an inverter application.

FIG. 13 is a schematic diagram of a matrix transformer of dimension M by N employed in an inverter application. Only the essential elements have been shown, it being understood that one skilled in the art of inverter design could readily provide the required drive circuits, snubbers, filters and so forth. The power source 133, the primary circuit 135, 135*a–n* and switching elements 131*aa–bn*, illustrated as NPN transistors, provide a suitable excitation for transformer elements 130*aa–mn*. Rectifying elements 132*aa–mb* provide a direct current output 134 via secondary circuit 136, 136*a–m*. It is a characteristic of an orthogonal matrix transformer that all switching elements 131*aa–bn* will share current equally, as will all rectifying elements 132*aa–mb*.

In the schematic of FIG. 13 each of the elemental interdependant transformers 130*aa–mn* is given its conventional schematic symbol. This emphasizes that a matrix transformer could indeed be made of a plurality of conventional transformers wired as shown, or in any other arrangement which is consistent with the laws of transformers. The transformers could have a large turns ratio, and that together with the matrix dimensions would determine the equivalent turns ratio of the matrix transformers as a whole.

The height of such a matrix transformer could be quite small, and the matrix transformer could mount on any flat surface, or even a curved or convoluted surface, or it could be distributed into available odd spaces, scattered around, but interwired electrically as a matrix transformer.

In the matrix transformer of FIG. 13, switching elements 131*aa–bn,* shown as NPN transistors, chop the primary voltage as is necessary for transformer operation. It is not unusual to need to parallel transistors in an application such as this, and it is always a problem to make them share the current. In an orthagonal matrix transformer, the elements cooperate interdependantly so that the current must be equal in each of the several transistors. Likewise it is not unusual to need to parallel rectifiers, and again it has always been a problem to make them share the current. In an orthogonal matrix transformer, the current must also be equal in the output paths.

Figure 14:
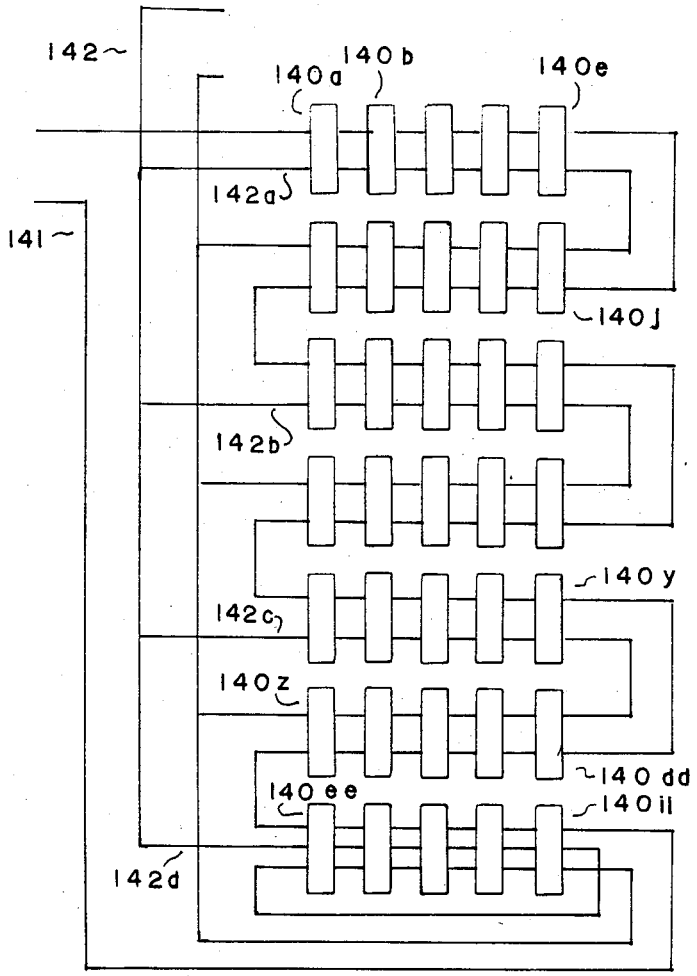
FIG. 14 is a diagramatic representation of a variation of the matrix transformer, showing that a matrix transformer does not need to have its windings orthagonal to each other, and that all elements need not be wired identically.

FIG. 14 is a diagramatic representation of a variation of the matrix transformer, and is inclined to show that a matrix transformer does not need to have its windings orthagonal to each other, and that all elements need not be wired identically as long as all of the component parts cooperate interdepentantly so that the transformer laws are not violated for any element when wired into the matrix. The primary winding 141 passes through all 35 cores 140*a–ii.* The secondary winding 142, has four parallel paths 142*a–d,* three of which 142*a–c* pass through ten cores each, 140*a–dd.* The fourth parallel path 142*d* passes twice through five cores 140*ee–ii.* The potential in this fourth path 142*d* is the same as in the three other paths 142*a–c,* as it must be, but the current in this fourth path 142*d* will have one half the contribution of the other three paths 142*a–c.*

Obviously when parallel wires pass through ten cores as shown, a single core of ten times the flux capacity would do, electrically and magnetically. However, there might be instances where it is necessary or desirable to use a plurality of smaller ones, such as for standardization, because of availability, or because of advantageous physical characteristics. Such a matrix transformer could be flatter, and could be contoured to fit in peculiar places, even on compound curved surfaces or distributed. However it would usually be preferred to wind the matrix transformer orthogonally.

Figure 15:
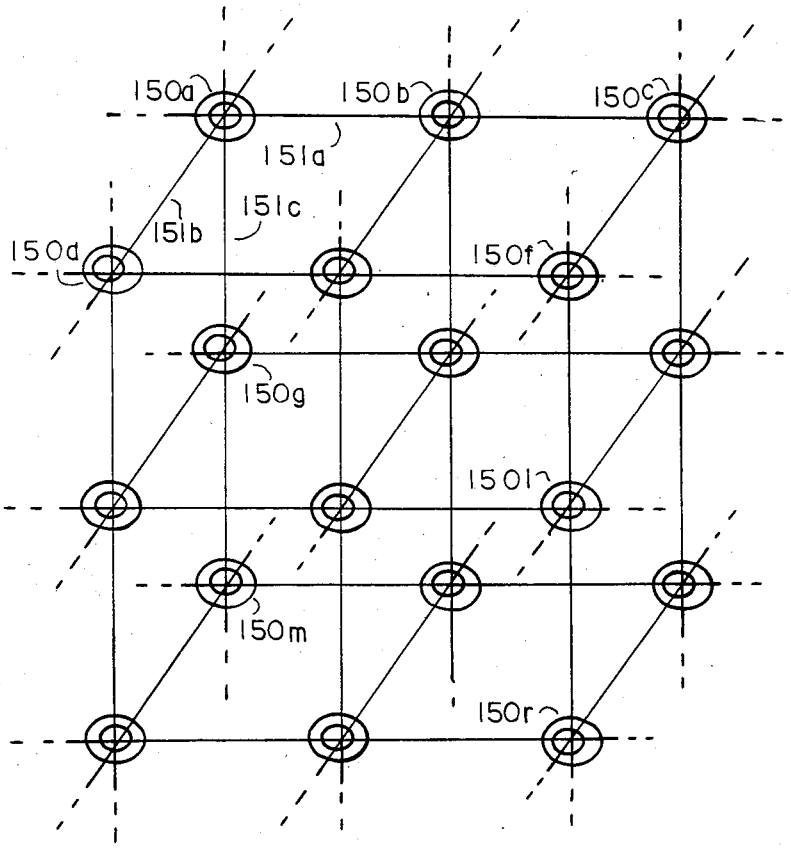
FIG. 15 is a diagramatic representation of a segment of a three dimensional matrix transformer.

FIG. 15 is a diagramatic representation of a segment of a three dimensional matrix transformer segment. Cores 150*a* through 150*r* are interwired by three windings 151*a, b* and *c* which interconnect, respecively rows, horizontal columns and verticle columns. Each winding 151*a, b* and *c* is understood to be a segment of a complete winding, and is generalized to represent any suitable winding interconnection.

Although increasingly complex, any one or two or all of the windings 151*a, b* and *c,* could be center tapped or split in the manner of FIG. 3, or could make multiple passes to increase the ratio.

The three dimensional matrix transformer does not necessarily need to be built in three dimensions physically, as long as an equivalent interconnection is used.

Figure 16A:
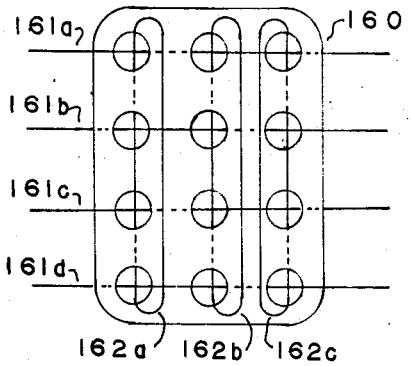
FIG. 16A is a diagramatic representation of a matrix transformer used to balance currents.
Figure 16B:
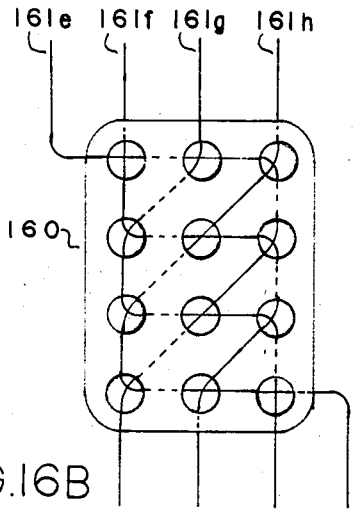
FIG. 16B is a diagramatic representation of an alternative matrix transformer used to balance currents.

FIGS. 16A and 16B show matrix transformers designed to ensure that the current in each of four circuits is equal. Although shown as single line circuits, the teachings of the invention are equally applicable to center tapped alternately switched circuits, such as inverter drive circuits, or center tapped or split secondary circuits, such as rectifying circuits.

In the current balancing matrix transformer of FIG. 16A, four circuits 161*a–d* pass through holes in a core structure 160. Each hole is an equivalent toroid, and toroids, pot cores, E-I cores, C cores or any other geometry could be used. As shown, there are a plurality of short circuit secondaries 162*a–c,* each of which passes through the core structure orthogonal to the four circuits 161*a–d,* each short circuit secondary coupling with each of the four circuits 161*a–d.* One such secondary is sufficient to ensure current balancing if there is sufficient flux capacity in the core structure to provided balancing voltages. The flux capacity can be increased by using either larger elements, or, as shown in FIG. 16A, by using more elements. The three circuits 162*a–c* could have been one circuit coupling all magnetic elements, it being exactly equivalent.

In the current balancing matrix transformer of FIG. 16B, it can be seen by carefully tracing the windings that each of the parallel circuits 161*e–f* crosses each of the other parallel circuits in two of the elements of the core structure 160. Therefor no circuit current can differ from the others without violating the transformer laws in some element. As long as there is sufficient flux capacity in the magnetic elements, voltages sufficient to ensure balance will be induced in the circuits 161*e–f.* The current balancing matrix transformer of FIG. 16*b* could have been designed with each winding making a single pass through a magnetic element for each other winding. The minimum number of magnetic elements is one half (N squared minus N), where N is the number of circuits to be balanced.

In the arrangement as shown, the flux capacity of the equivalent toroids can be quite small if the anticipated voltage differences to ensure balance are small. For instance, to balance currents in a bank of rectifiers, a fraction of a volt would likely be sufficient, though the possibility of having a D.C. component would have to be allowed for.

Figure 17:
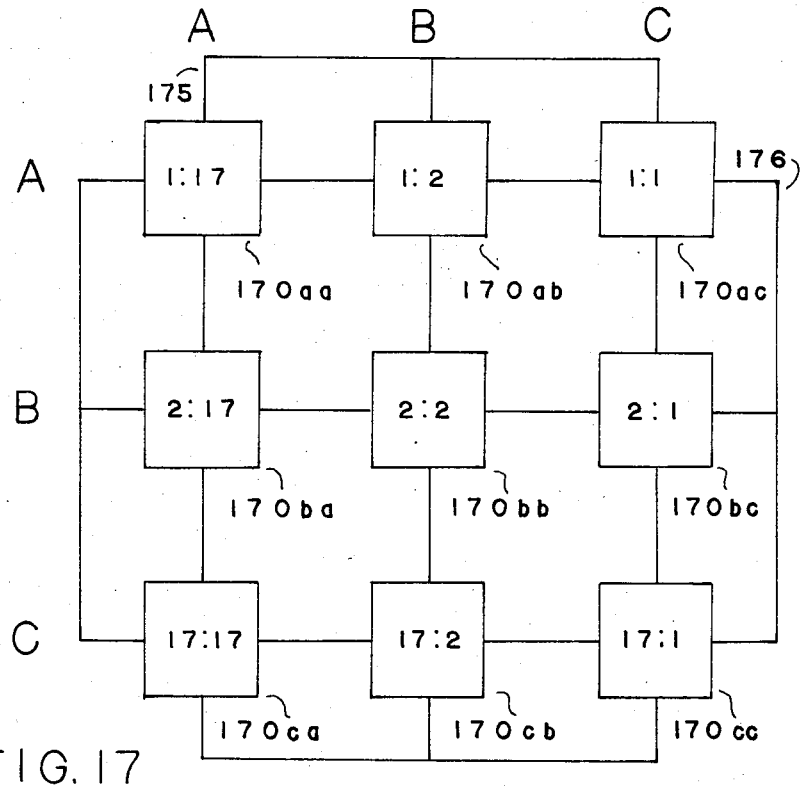
FIG. 17 is a block diagram of a variation of a matrix transformed in which the ratios of the interdependant magnetic elements vary greatly.
Figure 18:
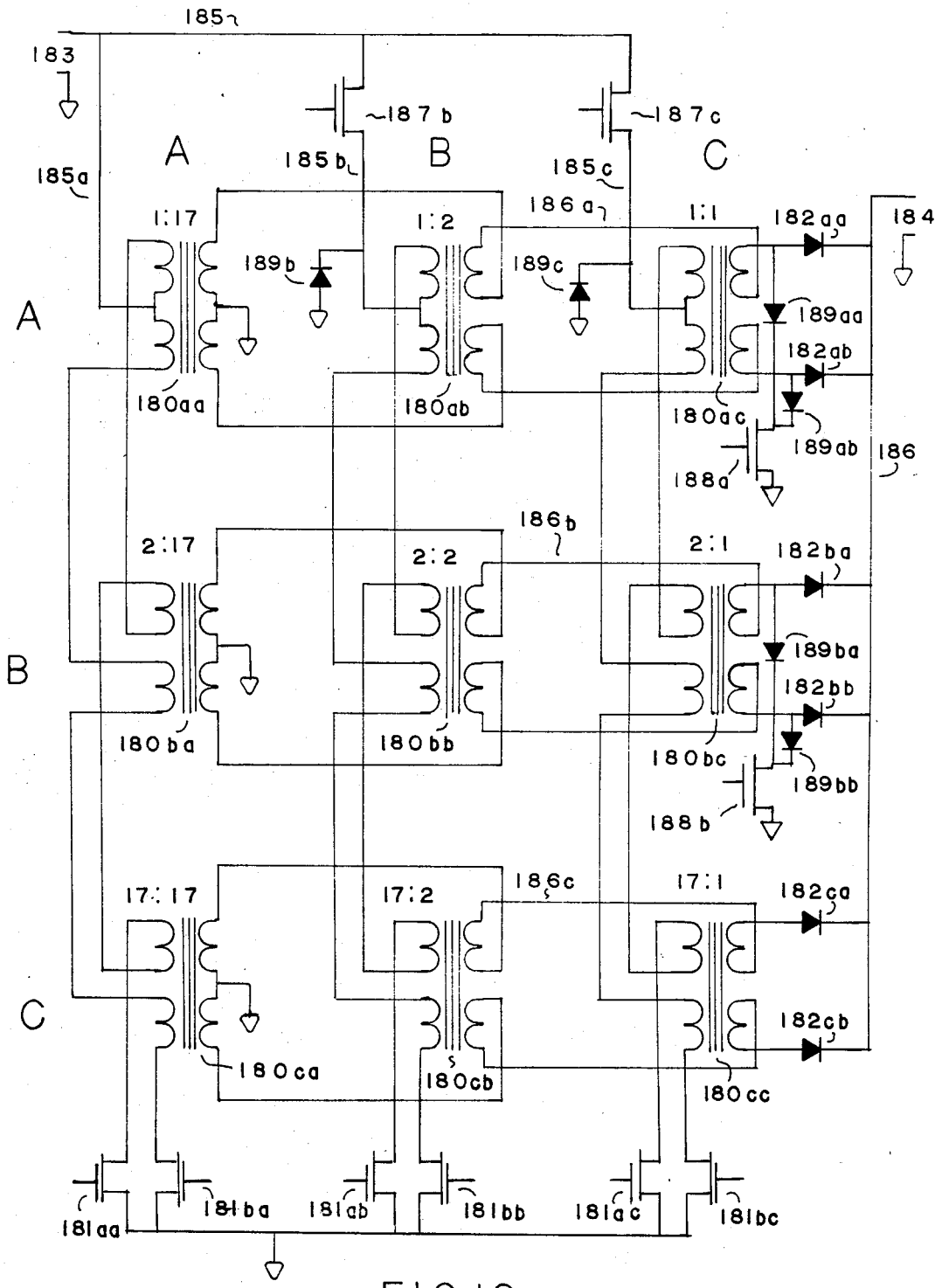
FIG. 18 is a schematic diagram of a variable matrix transformer used in an inverter application.

FIG. 17 teaches that the elements of a matrix transformer do not have to be the same. (The use of such an arrangement will be apparent when FIG. 18 is studied). FIG. 17 is a block diagram of a matrix transformer comprising 9 cooperating transformer elements 170*aa–cc,* lean having its equivalent turns ratio indicated in the corresponding block. The subscript 170*aa,ab–cc* of each element is taken from the row A, B or C, and the column, A, B or C in which it is placed. A first winding 175 consists of three parallel paths passign top to bottom, and a second winding 176 consists of three parallel paths passing left to right. Thus this matrix transformer is orthogonal.

The voltages and currents in the elements of this matrix transformer are hardly equal, but they are exactly determinable, and obey the laws of transformers. In each element, the net ampere turns is zero, and the volts per turn is the same in all windings. The current is the same in all series elements, and the voltage is equal across all parallel paths.

In analyzing any transformer, the voltage ratio primary to secondary is the same as the equivalent turns ratio. The current ratio primary to secondary is the inverse of the equivalent turns ratio. These ralationships makes it easy to analyze a matrix transformer such as the one in FIG. 17.

In analyzing a matrix transformer, one can analyze the currents in each element first, then use the voltage in each element as a verification. Since the current relationship is the inverse of the turns ratio, the denominator of the ratio (second number) is proportional to the current in the primary, and the numerator of the ratio is proportional to the current in the secondary.

To better visualize the current relationships in a matrix transformer, one can factor the ratios of the transformer elements so that the numerical values are proportional to units of current in the windings. Doing this necessarily results in having the same value for all windings which are in series. Thus in the matrix transformer of FIG. 17, the denominator of each ratio of each transformer element 170*aa–cc* is the same for any primary circuit which is in the same series path (column), and the numerator is the same for any secondary circuit which is in the same series path (row). Both transformer elements 170*ac* and 170*ca*, for instance, have 1 to 1 ratios, but the ratio of transformer element 170*ca* has been factored by 17 (17 to 17) to represent that the series paths through it must carry 17 times the current.

Preferably when the above steps are completed, each transformer element will have a ratio of whole numbers, though there are techniques for dealing with non-whole number ratios.

Now taking the inverse relationship, and looking at voltages, the numerator of each ratio will represent the proportional voltage drop of each transformer element top to bottom in any column, and the denominator of each ratio represents the proportional voltage contribution of each transformer element left to right in each row. Of course, the voltages in the windings of any one transformer element relate according to the ratio. If the voltages of any series path are added up, the sum will equal the sum in any other paths with whichit is in parallel.

The ratio of the whole matrix transformer is given by the sum of the numerators in any column to the sum of the denominators in any row. Thus the ratio of the matrix transformer of FIG. 17 is 20 to 20.

All of the ratios of the transformer elements of the matrix transformer can be factored by the same amount without destroying the validity of the relationship. Thus, if a 3 to 1 matrix transformer were desired, all numerators could be multiplied by three, to give a ratio of the whole transformer of 60 to 20, or 3 to 1.

Each element of a matrix transformer can itself be a matrix transformer. In the case of the matrix transformer of FIG. 17, it can be seen readily that the matrix transformer is indeed equivalent to a 20 by 20 matrix transformer. Transformer element 170*ca* can be a 17 by 17 matrix. Transformer element 170*cb* is made by adding two more columns, transformer element 170*ba* is made by adding two more rows, and transformer element 170*bb* results from filling in the corner. Continuing in this manner, one can complete the matrix transformer to show that it is equivalent to a 20 by 20 matrix transformer. Thus this block diagram could result from the analytical division of a matrix transformer, and the utility of this will be apparent with the study of FIG. 18.

Another useful feature of a matrix transformer having non-identical interdependant magnetic elements is the ability to build up a transformer having a desired equivalent turns ratio using a few simple interdependant magnetic elements, and the resulting matrix transformer may have better overall parameters (size, weight, flatness, low resistance or whatever) than an equivalent conventional transformer. Trial calculations can be made, and traded off.

Consider as an example, that one needs a transformer of 3.90 to 1. With a conventional transformer, the best winding that could be done is a 39 to 10. With a matrix transformer, a 1 by 3 matrix will do the job, where the first element is a 3 to 1 transformer (conventional or matrix), the second is a 1 to 2 transformer, and the third is a 2 to 5 transformer. In a 1 by N matrix transformer, the ratios add, so in our example we have 3/1 plus $\frac{1}{2}$ plus 2/5, or 3 plus 0.5 plus 0.4 equals 3.9. An N by 1 matrix transformer can also be considered, as can an M by N, and the resulting designs can be traded off to find the most suitable one.

FIG. 18 is a schematic diagram of a variable matrix transformer used in an inverter application, similar in many respects to the matrix transformer of FIG. 13 but with additional circuitry to enable varying the equivalent turns ratio by electronic switching means. The power source 183, the primary circuit 185, 185*a–c*, and the switching elements 181*aa–bc*, illustrated as field effect transistors, provide a suitable excitation to transformer elements 180*aa–cc*. Rectifying elements 182*aa–cb* provide a direct current output 184 via the secondary circuit 186, 186*a–c*. When the variable matrix transformer is being operated at its nominal ratio, switching elements 187*b,c*, illustrated as field effect transistors, are ON, and switching elements 188*a,b*, illustrated as field effect transistors, are OFF. Rectifying elements 189*b–bb* are used when turns ratio switching is employed.

The equivalent turns ratio of each transformer element 180*aa–cc* is noted above its schematic representation, and will be seen to be the same as the equivalent turns ratios in the corresponding blocks 170*aa–cc* of the matrix transformer of FIG. 17. The nominal ratio of the variable matrix transformer of FIG. 18 is 20 to 20.

A valuable feature of the variable matrix transformer of FIG. 18 is the ability to change its equivalent turns ratio by electronic switching. If switching element 188*a* is turned ON, the circuit 186*a* of row A is effectively short circuited through rectifiers 189*aa,ab*. Current will flow through the transformer elements, 180 *aa, ab* and *ac*, but the potential contribution will be zero (ideally). This effectively alters the equivalent turns ratio to 19 to 20, and the output voltage will be higher, by about five percent.

Similarly, if switching element 188*b* provides a short circuit to secondary 186*b* via rectifiers 189*ba,bc*, row B will have no potential contribution, and the equivalent turns ratio will be 18 to 20. If both switching elements 188*a,b* are ON, the equivalent turns ratio will be 17 to 20.

Similarly, if switching element 187*c* is turned OFF, and both switching elements 181*ac,bc* are turned ON, the transformer elements 180 *ac, bc* and *cc* will be shorted. Current will flow in them, but they will make no potential contribution, and the equivalent turns ratio of the variable matrix transformer will be 20 to 19. If switching element 187*b* is turned OFF, and both switching elements 181*ab,bb* are turned ON, the equivalent ratio will be 20 to 18. If both switching elements 187*b,c* are OFF, and all four switching elements 181*ab,bb,ac* and *bc* are ON, the equivalent ratio will be 20 to 17.

Thus in the example of FIG. 18, the equivalent turns ratio can be varied up or down by approximately five, ten or fifteen percent by "removing" rows or columns.

The performance of the variable matrix transformer of FIG. 18 is optimum at nominal ratio, with no rows or columns "removed". When a row or column is "removed", a short circuit current flows in it, which ideally has zero power, but which in reality will represent losses. Thus the variable matrix transformer of FIG. 18, with its associated inverter circuitry, would be optimum for voltage adjustment up or down in cases when the voltage was nominally mid value.

The Variable Matrix Transformer of FIG. 18 is a 3 by 3 matrix, but could be extended to N by M to give more control and greater resolution of variability.

A 1 by N and an M by 1 Variable Matrix transformers are special cases of the variable matrix transformer. Since the variable matrix transformer is most efficient when no rows or columns are removed, the 1 by N is more efficient when a nominally high ratio is desired, and the M by 1 is more efficient when a nominally low ratio is desired. The control on a M by 1 matrix transformer is somewhat simpler, as removing the "rows" (consisting in this case of single elements) is acomplished by turning on a single transistor for each.

A 1 by M Matrix transformer could function as a multiplying digital to analog converter with the transformer elements designed with ratios that were a binary progression. A N by 1 matrix transformer would provide the inverse function, and one of each could be put in series to provide an output which was the input times the ratio of two digital numbers.

Figure 19:
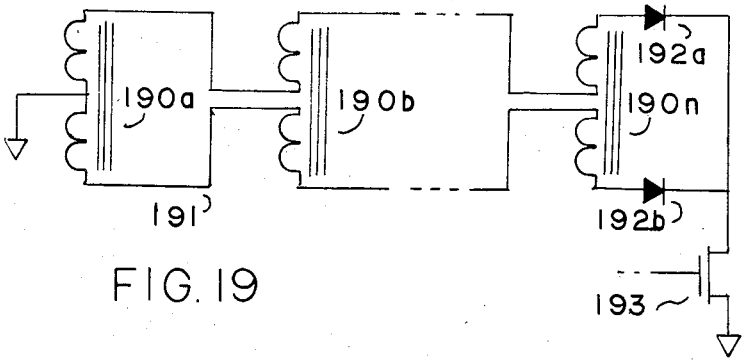
FIG. 19 is a schematic diagram showing an alternative method of short circuiting either a row or a column in a variable ratio matrix transformer.

FIG. 19 is a schematic diagram showing an alternative method of short circuiting either a row or a column in a variable ratio matrix transformer, such as the one of FIG. 18. Interdependant magnetic elements 190*a,b,–n* are the interdependant magnetic elements of any row or column of a variable ratio matrix transformer. Circuit 191 is grounded at a centertap of interdependant magnetic element 190*a*, and is in series with split windings on the other interdependant magnetic elements 190*b,–n*. Rectifying means 192*a,b* will normally block currents which may try to flow in either direction in circuit 191, and the circuit 191 will have no effect on the performance of the variable ratio matrix transformer. If Switching means 193 is turned ON, however, short circuit currents will flow in circuit 191 for either polarity, which will effectively short circuit any other windings on the interdependant magnetic elements 190*a,b,–n*.

As discussed above, one method of providing finer resolution of adjustment for a variable ratio matrix transformer is to extend the dimensions of the matrix to a larger size, and provide more control, as for instance, in a binary sequence. Another method would be to employ pulse width modulation techniques.

Consider the matrix transformer of FIG. 18 once again. It was seen that the equivalent turns ratio of the matrix transformer could be varied by about five percent by closing swithching means 188*a*. To achieve a smaller percentage change, the closure of switching means 188*a* could be pulse width modulated to yield a time averaged equivalent turns ratio with a smaller net change as a function of the duty cycle. In as much as the duty cycle can be any percentage, infinite resolution can be obtained as a time averaged equavelent turns ratio.

Figure 20:
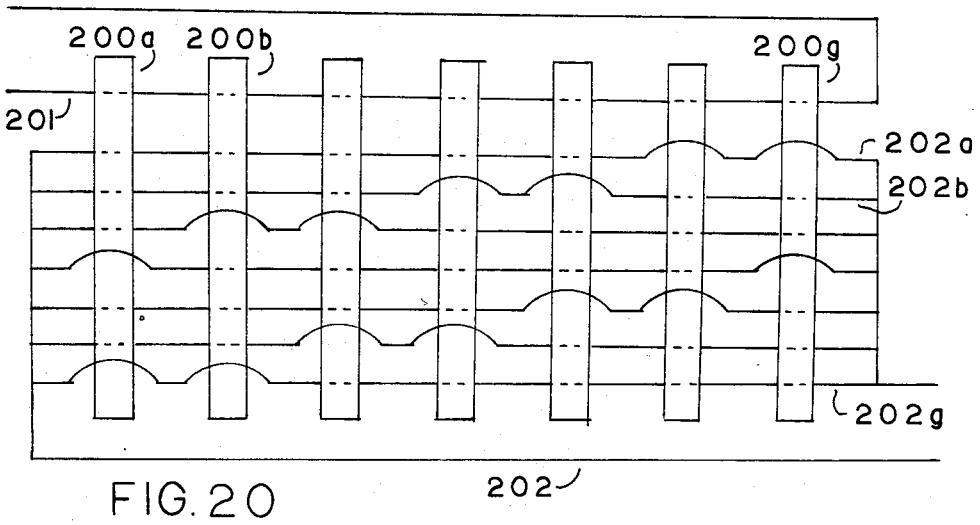
FIG. 20 is a diagramatic representation of a cyclically wound matrix transformer.

FIG. 20 is a diagramatic representation of a cyclically wound matrix transformer having an effective turns ratio of 7 to 5, and, at the expense of having more elaborate windings, uses far fewer cores than a 7 by 5 orthogonal matrix transformer. A primary winding 201 passes through seven interdependant magnetic elements shown diagramatically as toroids 200*a,b,–g*. A secondary winding 202 consists of seven parallel paths 202*a,b,–g*. Each path passes through five of the toroids, skipping two. This pattern is continued cyclically, staggering the skip until each toroid 200*a,b,–g* has five secondary circuit paths passing through it, none having more or less. If the net ampere turns in each toroid is to be zero, then each secondary path will have one fifth of the primary current. There being seven parallel paths, the secondary current will therefor be 7/5 times the primary current, and the secondary voltage will be 5/7 times the primary voltage.

Figure 21:
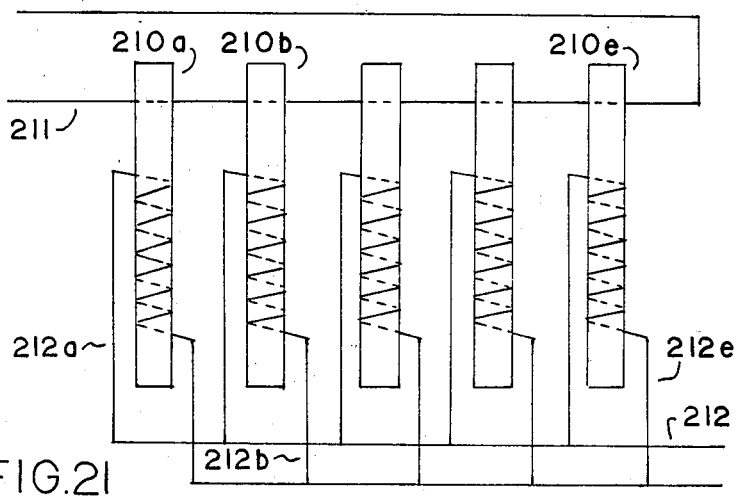
FIG. 21 is a diagramatic representation of another cyclically wound matrix transformer.

FIG. 21 is a diagramatic representation of another cyclically wound matrix transformer having an equivalent turns ratio of 5 to 7. The principle is not unlike that of the matrix transformer of FIG. 20. A primary circuit 211 passes through five interdependant magnetic elements, represented diagramatically as toroids 210*a,b,–e*. A secondary circut 212 consists of five parallel paths 212*a,b,–e*, each making seven turns around one of the toroids. For the net ampere turns in each toroid 210*a,b,–e* to be zero, the secondary current in each path must be one seventh of the primary current. Because there are five parallel paths, the total secondary current will be 5/7 times the primary current, and the secondary voltage will be 7/5 times the primary voltage.

Figure 22:
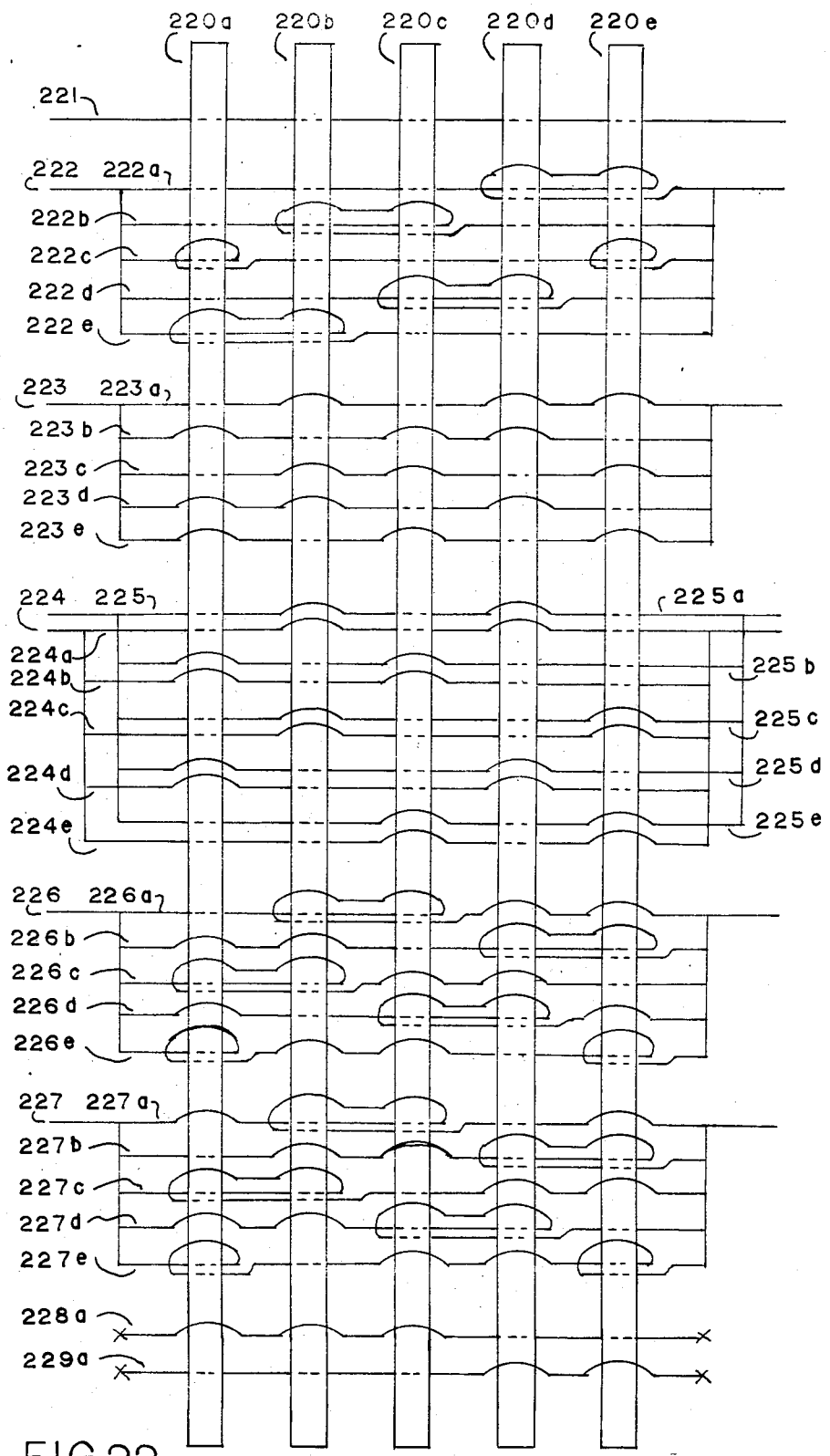
FIG. 22 is a diagramatic representation of another cyclically wound matrix transformer, intended for turorial purposes to show a variety of possible winding methods, and to show some errors.

FIG. 22 is a diagramatic representation of another cyclically wound matrix transformer, intended for turorial purposes to show a variety of possible winding methods. A first winding 221 makes a single pass through five interdependant magnetic elements, shown as toroids 220*a–e*. Windings 222 through 227 illustrate possible windings. Windings 228 and 229 are incomplete, and show errors.

The second winding 222 comprises five parallel paths 222*a–e*, and each of the parallel paths passes through all five toroids, then makes a second pass through two of them to provide an equivalent turns ratio of 5 to 7. It is necessary to have the five parallel paths picking up different extra pairs in a similar cyclical arrangement in order to obey the law of currents in transformers. The currents in the five parallel paths 222*a–e* will be balanced. Other arrangements are possible.

The third winding 223 comprises five parallel paths 223*a–e*, and each one passes through three of the five toroids. Note that the individual windings do not pick up three consecutive windings, in the manner of the winding 228*a*. This is to preserve current balancing. As shown, the third winding 223 is compatible with the second winding 222, and both will be current balanced. The equivalent turns ratio from the primary 221 to this third winding 223 is 5 to 3.

If the third winding 223 had been made of five parallel paths which picked up consecutive toroids, in the manner of winding 228*a*, current balancing would not hold. This is because, for some one path of 222 and some one path of 223, the three cores that were picked up in 223 would align with the three cores that had only a single pass in 222. For illustration, consider 222*a* and 228*a*. 222*a* could have a current higher than 222*b–e* if 228*a* had a lower current, and the ampere-turns in each toroid could still be zero. This is not possible if the cycles of the windings do not align.

The fourth and fifth windings 224 and 225 of the Cyclically Wound Matrix Transformer of FIG. 22 show how to construct a split winding. As shown it is equivalent to four turns split (two plus two). It is obvious that a centertapped winding could be constructed similarly. Note that the two toroids picked up by each parallel path allign to each other, but not to the other windings, to preserve current balancing.

The sixth and seventh windings 226 and 227 both pick up five toroids, but have different cycles, so that current balancing is preserved in each of them.

The partial winding 229*a* has the same problem as discussed above with 228*a* in that it can upset the balance in 222 by interacting with 222*a*.

For many applications, current balancing would not be a consideration. It is really important only if external devices can benefit from having the current devided and balanced, such as drive transistors for an inverter, or parallel rectifiers in one or more secondaries.

If current balancing is not important, the mismatching of cycles between windings is unimportant. If current balancing is important, it can be difficult to see by inspection if it is preserved when there are several windings. The best method to analyze this is to take each individual parallel path of each winding, and analyze it in relationship to all others, one by one. If a change in current in one can be compensated for by a change in the other, then current balance will not be assured.

The above discussions in this specification should make it apparent there is no single preferred embodiment of the Matrix Transformer, but rather there is a principle and method which can be applied to the art of transformer design in novel ways to meet diverse applications.

I claim:

1. A matrix transformer, comprising a plurality of interdependant magnetic elements, and at least two windings interconnecting the interdependant magnetic elements, arranged and disposed so that each of the windings comprises at least one current carrying conductor path between and through the interdependant magnetic elements, each current carrying conductor path through each of the interdependant magnetic elements interacts by magnetic induction with the magnetic element and with any and all other current carrying conductor paths which pass through the same magnetic element so that the net ampere-turns in any magnetic element is zero, the volts per turn developed by magnetic induction at any one of the interdependant magnetic elements is equal for all current carrying conductor paths which passes through that one magnetic element, the current in any of the current carrying conductor paths is equal, between and through any and all of the interdependant magnetic elements through which the current carrying conductor path passes, and throughout its entire length, the potential which is developed in any of the current carrying conductor paths of any winding is equal to the potential which is developed in any of the other current carrying conductor paths of the winding with which it is in parallel, and the whole cooperates interdependantly so as to function as a transformer.

2. An embodiment of the matrix transformer of claim 1, a two dimensional orthogonal matrix transformer comprising the plurality of interdependant magnetic elements interwired as an indefinite matrix of dimensions M and N, M being the number of columns and N being the number of rows.

3. An embodiment of the matrix transformer of claim 1, a three dimensional orthogonal matrix transformer comprising the plurality of interdependant magnetic elements interwired as an indefinite matrix of dimensions X, Y and Z, X being the number of columns, Y being the number of second dimension rows, and Z being the number of third dimension rows.

4. The matrix transformer of claim 1, having a primary winding and a secondary winding, and further having a voltage modifying winding, compising at least one additional interdependant magnetic element, and at least one additional winding the voltage modifying winding coupling through the additional magnetic elements to all branches of at least one secondary winding, but not coupling to any branch of the primary winding, whereby a voltage impressed on the voltage modifying winding will be induced into the secondary winding, added to the voltage induced by the primary winding (each as a factor of its equivalent turns ratio).

5. The matrix transformer of claim 1, in which at least one winding is a center-tapped winding.

6. The matrix transformer of claim 1, in which at least one winding is a split winding.

7. The matrix transformer of claim 1, in which at least one of the interdependant magnetic elements is itself a matrix transformer.

8. The matrix transformer of claim 1, wherein the interdependant magnetic elements comprise at least one pair of the cross cores, there being four interdependant magnetic elements for each cross core pair, one between each corner magnetic return path and the center magnetic path.

9. The matrix transformer of claim 8, in which at least one of the windings is a printed circuit board, captured between the halves of the cross cores pairs, the magnetic. paths and return paths of the cross core pairs passing through holes in the printed circuit board.

10. The matrix transformer of claim 1, in which the interdependant magnetic elements are integral to a plate of magnetic material having therein a plurality of holes, one for each of the interdependant magnetic elements, and where each of the interdependant magnetic elements comprise the portion of the plate of magnetic material which immediately surrounds each of the holes.

11. The matrix transformer of claim 1, in which the interdependant magnetic elements are integral to a first plate of magnetic material having there on a plurality of protrusions and a second plate of magnetic material laid across and in proximate contact with the protrusions of the first plate of magnetic material, whereby a plurality of closed magnetic circuits are formed, each of which, when interwired into a matrix transformer, forms an interdependant magnetic element of the matrix transformer.

12. The matrix transformer of claim 11, in which at least one of the windings is a printed circuit board which is captured between the first and second plates of magnetic material, and through which the protursions of the first plate of magnetic material pass.

13. The matrix transformer of claim 1, in which the interdependant magnetic elements are toroids, with current carrying conductor paths passing through them.

14. A variable matrix transformer, comprising a matrix transformer, means to effectively remove at least one of the interdependant magnetic elements of the matrix transformer so as to effectively make a different matrix transformer having fewer elements and which has a different effective turns ratio, comprising at least one isolation means to effectively open circuit current carrying conductor paths which pass through the interdependant magnetic elements which are to be removed and which form current carrying conductor paths which are in parallel with other current carrying conductor paths, and at least one short circuit means to effectively short circuit current carrying conductor paths which pass through the interdependant magnetic elements which are to be removed and which are part of a series circuit passing through other interdependant magnetic elements which are not to be effectively removed, whereby the effective turns ratio of the variable matrix transformer may be incrementally varied.

15. The variable matrix transformer of claim 14, further comprising pulse width modulating control means to vary the duty cycle of operation of the means to effectively remove at least one of the interdependant magnetic elements of the matrix transformer, whereby the time averaged effective turns ratio of the variable matrix transformer may be varied.

16. A current balancing matrix transformer, comprising one winding for each circuit in which the current is to be balanced with the current in the other circuits, at least one interdependant magnetic element for each circuit in which the current is to be balanced, and through which the winding for the circuit in which the current to be balanced passes, and at least one short circuited winding passing through the interdependant magnetic elements, orthogonal to, and coupled by magnetic induction to each of the windings for the circuits in which current is to be balanced, whereby the law of currents in transformers force the current in each circuit to be balanced so that the net ampere turns in each of the interdependant magnetic elements is zero and sufficient potential will be generated in each of the interdependant magnetic elements to force a balance.

17. A current proportioning matrix transformer, comprising one winding for each circuit in which the current is to be proportioned with the current in the other circuits, at least one interdependant magnetic element for each circuit in which the current is to be proportioned, and through which the winding for the circuit in which the current to be proportioned passes, and at least one short circuited winding passing through the interdependant magnetic elements, orthogonal to, and coupled by magnetic induction to each of the windings for the circuits in which current is to be proportioned, and having turns ratio at element which is the proportionate current for the circuit which passes through that interdependant magnetic element to a common denominator which is the current in the short circuit winding, whereby the law of currents in transformers force the current in each circuit to be proportioned so that the net ampere turns in each of the interdependant magnetic elements is zero and sufficient potential will be generated in each of the interdependant magnetic elements to force the proportioning.

18. A current balancing matrix transformer, comprising a winding for each circuit in which current is to be balanced, at least one half (N squared minus N) interdependant magnetic elements, where N is the number of circuits in which the current is to be balanced, the windings being arranged and disposed so that each of the windings in which current is to be balanced passes through at least one independant magnetic element for each other circuit in which current is to be balanced, the windings being in opposition so that when the currents are in balance, the net ampere turns in each of the interdependant magnetic elements is zero.

19. A current sharing matrix transformer, comprising a plurality of interdependant magnetic elements, interwired as a matrix transformer of at least two dimensions, and having at least one winding for each dimension of the matrix transformer, the windings for each dimension being orthogonal to the windings for the other dimensions, having at least one of the windings comprising at least two parallel current conducting paths, each of the parallel current conducting paths interwiring at least one row of the magnetic elements of the current sharing matrix transformer in the dimension of the winding of which it is a part, and the parallel current conducting paths of any winding taken all together interwiring all of the rows of the magnetic elements of the current sharing matrix transformer in the dimension of the winding of which they are parts, whereby the current in each of the parallel current conducting paths of any winding will be a fixed portion of the total current in that winding, as determined by the law of currents in transformers when applied to the interdependant magnetic elements with which each of the parallel current conducting paths is interwired.

20. A cyclically wound matrix transformer, comprising a plurality of interdependant magnetic elements, and at least two windings interconnecting the iterdependant magnetic elements, arranged and disposed so that each winding comprises at least one current carrying conductor path between and through the interdependant magnetic elements, and at least one winding is a cyclically wound winding, and comprises at least a quantity of parallel current carrying conductor paths equal to the quantity of interdependant magnetic elements, each of the parallel current carrying conductor paths of the cyclically wound winding making at least one turn around at least one of the interdependant magnetic elements, all of the parallel current carrying conductor paths of the cyclically wound winding making the same number of turns around the same number of interdependant magnetic elements, in a particular pattern each of the parallel current carrying conductor paths of the cyclically wound winding repeating the pattern of the others, each of the parallel current carrying conductor paths of the cyclically wound winding having the position of its pattern displaced from the position of the pattern of the others, relative to the interdependant magnetic elements, such that the patterns repeat from parallel current conducting path to parallel current conducting path of the cyclically wound winding in a cyclical manner, and all of the interdependant magnetic elements have the same number of turns total from the sum of the parallel current conducting paths of the cyclically wound winding.

* * * * *